US006183297B1

(12) United States Patent
Kay et al.

(10) Patent No.: US 6,183,297 B1
(45) Date of Patent: Feb. 6, 2001

(54) COAXIAL CONNECTOR

(75) Inventors: Gregory L. Kay, Chicago; Wallace H. Hepkema, Northbrook, both of IL (US)

(73) Assignee: Tech Lighting, L.L.C., Chicago, IL (US)

( * ) Notice: Under 35 U.S.C. 154(b), the term of this patent shall be extended for 0 days.

(21) Appl. No.: 09/363,757

(22) Filed: Jul. 29, 1999

(51) Int. Cl.[7] ..... H01R 9/05
(52) U.S. Cl. ..... 439/578; 439/675; 362/147
(58) Field of Search ..... 439/578, 814, 439/675, 63, 574; 362/147

(56) References Cited

U.S. PATENT DOCUMENTS

| | | | | |
|---|---|---|---|---|
| 3,668,612 | * | 6/1972 | Nepovim | 439/584 |
| 4,076,367 | * | 2/1978 | Avins | 439/583 |
| 4,135,776 | * | 1/1979 | Ailawadhi et al. | 439/583 |
| 4,241,973 | * | 12/1980 | Mayer et al. | 439/581 |
| 5,232,377 | * | 8/1993 | Leibfried, Jr. | 439/320 |
| 5,769,662 | * | 6/1998 | Stabile et al. | 439/578 |
| 6,058,230 | * | 5/2000 | Ward | 358/33 |

* cited by examiner

*Primary Examiner*—Khiem Nguyen
*Assistant Examiner*—Hae Moon Hyeon
(74) *Attorney, Agent, or Firm*—Wood, Phillips, VanSanten, Clark & Mortimer

(57) ABSTRACT

A connector for a coaxial cable having an conductive inner cable surrounded by a conductive outer cable with an insulator between the inner and outer cables. The conductor includes a conductive first base member having a first opening therethrough adapted to received the inner and outer cables therein, an insulating member secured to the first base member and having a second opening therethrough substantially in alignment with the first base member first opening, and a conductive second base member secured to the insulating member and conductively insulated from the first base member. The insulating member second opening is restricted relative to the first base member first opening whereby the second opening is adapted to receive the inner cable and the insulator and to block the outer cable from entry into the second opening. The second base member has a pocket substantially in alignment with the first and second openings and adapted to receive the inner cable and the insulator therein. A first clamping member is adapted to secure the outer cable when in the first base member opening, and a second clamping member is adapted to secure the inner cable when in the second base member pocket. The base members are adapted to connect to opposite sides of a power circuit. A transverse opening in the second base member provides a visual opening into the pocket. In another aspect, a hanging light is provided including a light fixture secured on one end of the coaxial cable and the connector secured to the other end of the coaxial cable, with the connector adapted to connect to two sides of a power circuit for operation of the light fixture.

12 Claims, 4 Drawing Sheets

Fig. 3
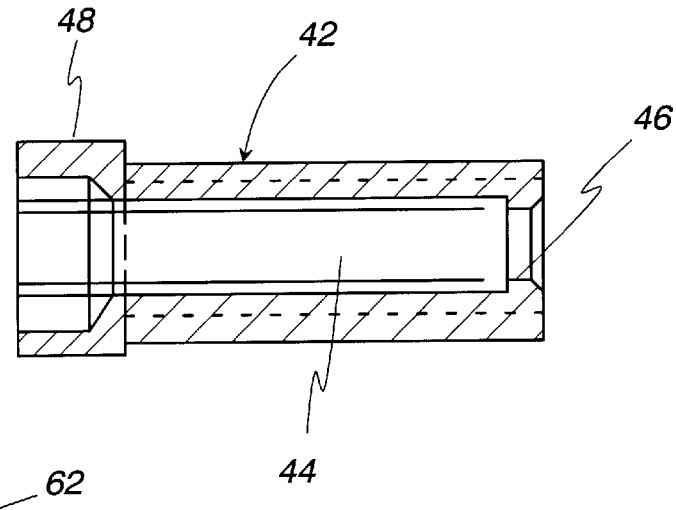
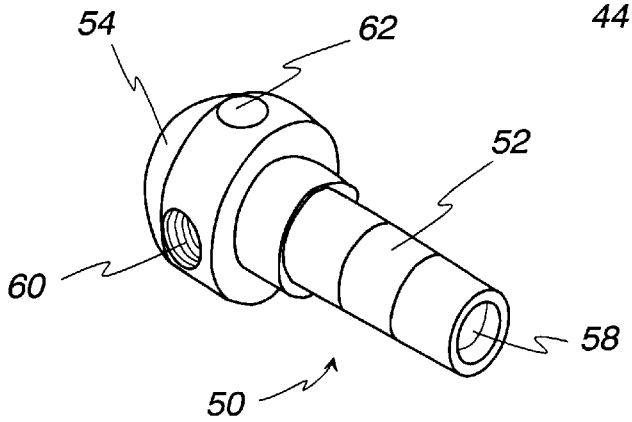
Fig. 4
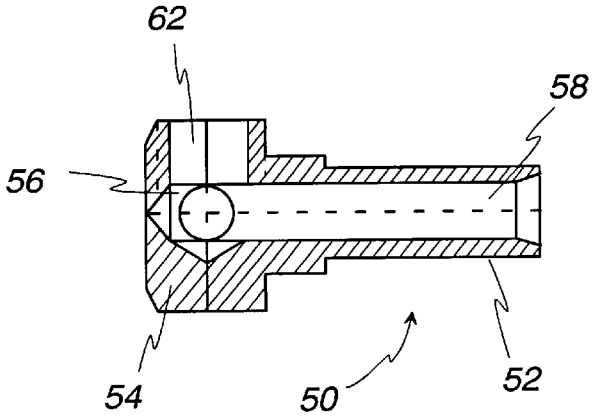
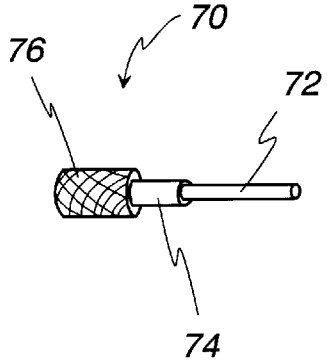
Fig. 5
Fig. 6

COAXIAL CONNECTOR

BACKGROUND OF THE INVENTION

1. Technical Field

The present invention is directed toward coaxial cable connectors, and more particularly toward connectors for coaxial cable-hung light fixtures.

2. Background Art

Lighting is an important part of the aesthetics of an interior area, not only with respect to the light provided but respecting the appearance of the light fixtures themselves. Many different types of light fixtures are provided to suit many different types of styles and tastes.

One such type of lighting which is often used has light fixtures which hang from coaxial cables. These fixtures are very flexible in installations, as the hanging length may be cut to suit the particular room or area in which the installation is to occur. Further, such lights may be readily installed to either hang from individual ceiling mounted bases, or from a track (thereby allowing multiple light fixtures to be spaced along the track as desired both for appearance and lighting purposes).

One type of such lighting system which has been used is known as the FreeJack™ System. With these systems, the light fixture is connected to one end of a coaxial cable and a connector is secured to the other end of the coaxial cable, which connector may be quickly and easily connected to a mating ceiling mounted fixture to not only support the light fixture but also connect it to the power circuit. A connector used with such lighting systems typically includes a pair of base members with an insulating member therebetween and a central opening for the coaxial cable. During installation, the coaxial cable is cut to the desired overall length, a specified amount of the outer cable (typically forming a sheath around the cable) is trimmed from the end, and a specified amount of the insulation around the projecting portion of the inner cable is shaved off, at which point the cable end is inserted into the connector central opening with the exposed inner cable clamped in one base member to form an electrically conductive connection and the uncut end portion of the outer cable clamped in the other base member to form an electrically conductive connection to that other base member. While such light fixtures provide good operation and flexibility, the above described installation can encounter some problems. For example, stripping off the outer cable and insulation can be time consuming, and any error in doing so can result in an improper connection to the power circuit so that the light may not work properly. Further, it is possible when stripping off the outer cable and the insulation to also inadvertently cut off the end portion of the inner cable. If that occurs, the entire cable might be discarded and work in connecting it between the connector and light fixture be then repeated. Alternatively, the installer could repeat the process on the end of the remaining portion of the coaxial cable, in which case the light fixture will not hang down as far as desired. Either case is undesirable as both involve waste of time and materials, and in the later case might seriously damage the aesthetic appearance (particularly when the lighting involves multiple fixtures where even small variations in hanging distances can be very obvious and unattractive).

The present invention is directed toward overcoming one or more of the problems set forth above.

SUMMARY OF THE INVENTION

In one aspect of the present invention, a connector is provided for a coaxial cable having an conductive inner cable surrounded by a conductive outer cable with an insulator between the inner and outer cables. The conductor includes a conductive first base member having a first opening therethrough adapted to received the inner and outer cables therein, an insulating member secured to the first base member and having a second opening therethrough substantially in alignment with the first base member first opening, and a conductive second base member secured to the insulating member and conductively insulated from the first base member. The insulating member second opening is restricted relative to the first base member first opening whereby the second opening is adapted to receive the inner cable and the insulator and to block the outer cable from entry into the second opening. The second base member has a pocket substantially in alignment with the first and second openings and adapted to receive the inner cable and the insulator therein. A first clamping member is adapted to secure the outer cable when in the first base member opening, and a second clamping member is adapted to secure the inner cable when in the second base member pocket. The base members are adapted to connect to opposite sides of a power circuit.

In a preferred form of this aspect of the present invention, the second opening includes a tapered opening adjacent the first base member, the tapered opening being adapted to guide the inner cable and insulation into the second opening while blocking the outer cable.

In another preferred form, the first and second clamping members comprise set screws in threaded holes oriented substantially perpendicular to the orientation of a coaxial cable when connected thereto, the set screws being adapted to pinch the coaxial cable in the first base member opening and second base member pocket when received therein.

In still another preferred form, a transverse opening is provided in the second base member providing a visual opening into the pocket.

In yet another preferred form, the insulating member second opening is threaded and receives a threaded portion of the second base member therein, the threaded portion having a central opening extending to the pocket and adapted to receive the inner cable and insulator therethrough.

In another preferred form, the second clamping member is adapted to break through the insulator to create a conductive connection between the inner cable and the second base member when the inner cable is secured in the second clamping member.

In another aspect of the present invention, a hanging light is provided, including a light fixture having two terminals, a coaxial cable such as described above secured to the light fixture, and a connector secured to the coaxial cable such as described above, the connector being adapted to connect to two sides of a power circuit for operation of the light fixture.

Preferred forms such as described with the first aspect of the invention are also preferred forms with this aspect of the invention.

It is an object of the invention to provide a connector for a coaxial cable which may be easily used and installed.

BRIEF DESCRIPTION OF THE DRAWINGS

FIG. 3 is a cross-sectional view of the insulator of the FIG. 1 embodiment;

FIG. 4 is an enlarged perspective view of the connector contact of the FIG. 1 embodiment;

FIG. 5 is a cross-sectional view of the connector contact of FIG. 4;

FIG. 6 is a view of a coaxial cable with which the connector of FIG. 1 may be used;

DESCRIPTION OF THE PREFERRED EMBODIMENT

Figure 1:
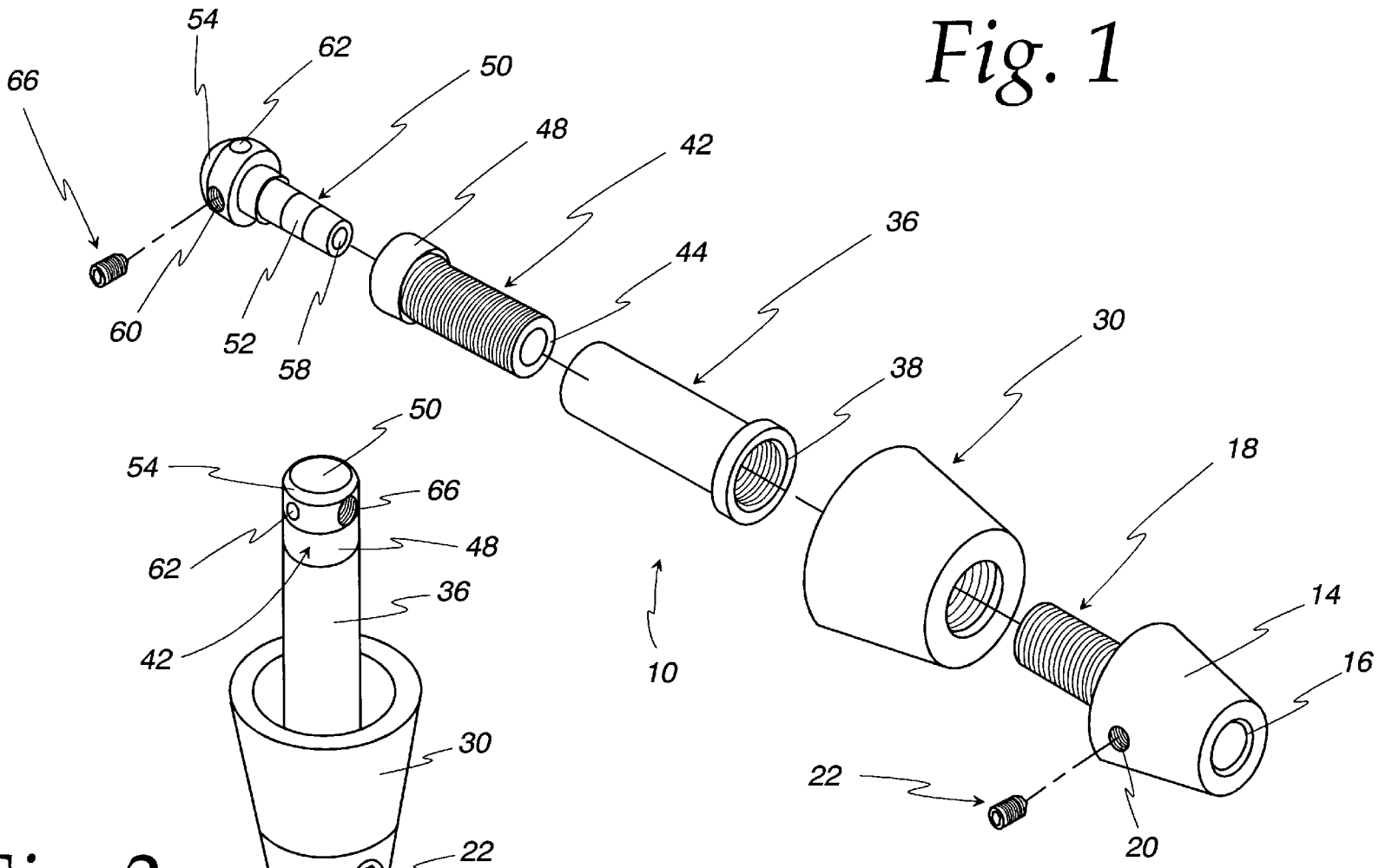
FIG. 1 is an exploded perspective view of a preferred embodiment of the present invention.
Figure 2:
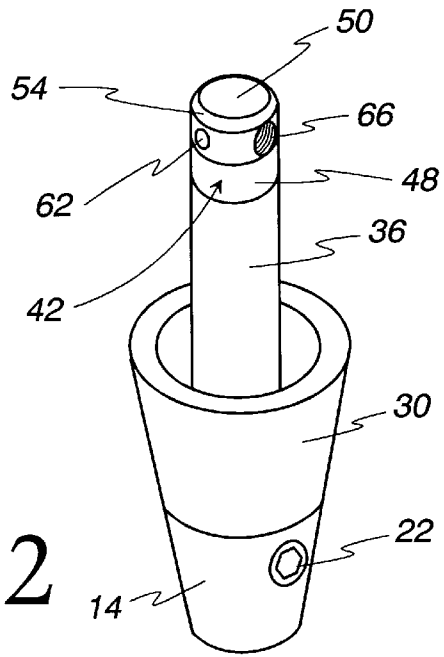
FIG. 2 is a perspective view of the FIG. 1 embodiment as assembled.
Figure 8:
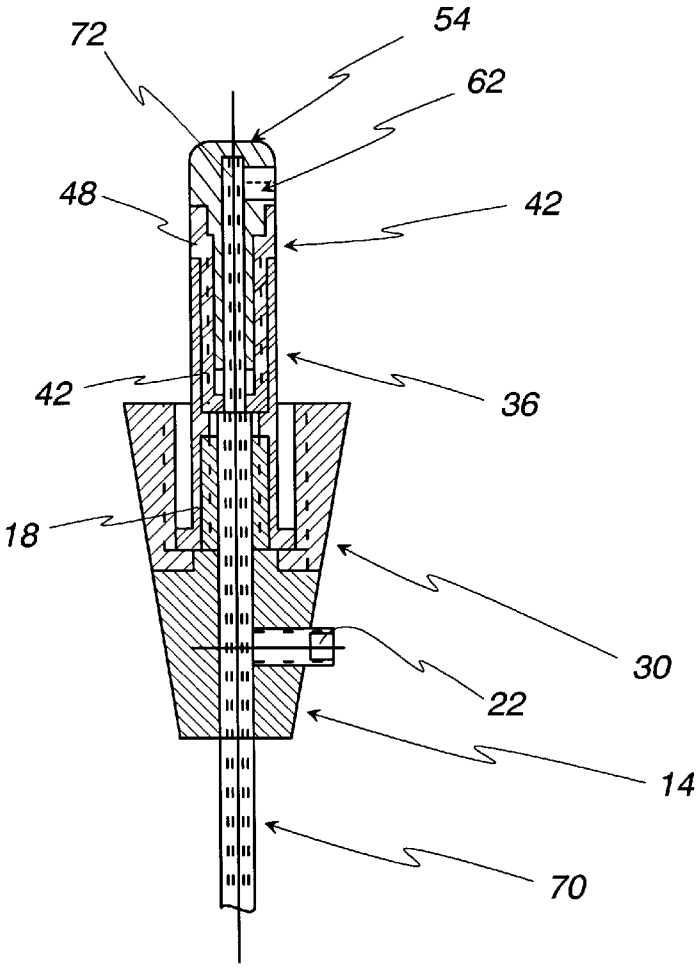
FIG. 8 is a cross-sectional view taken along line 8—8 of FIG. 7.

One embodiment of a connector 10 according to the present invention is shown in exploded view in FIG. 1. The connector 10 includes a connector adapter or base member 14 having a central cylindrical opening 16 extending therethrough and including a threaded portion 18 on one side thereof. A threaded opening 20 is also provided transverse to the cylindrical opening, and receives a suitable set screw 22 therein for a purpose described in greater detail hereafter.

A connector nut 30 is located over the adapter threaded portion 18 but does not thread onto the threaded portion 18. A connector nipple 36 having a central threaded opening 38 is screwed on the adapter threaded portion 18 and thereby secures the connector nut 30 thereon while allowing free pivoting of the connector nut 30 relative to the adapter 14 and connector nipple 36.

The connector adapter 14, connector nut 30 and connector nipple 36 are all preferably made of a hard metallic material which is electrically conductive, brass being one example of a suitable material. Further, the outer surfaces of the connector adapter 14 and connector nut 30 may also be aesthetically treated, for example, by plating the surfaces with gold, chrome, silver, bronze or nickel, or by painting to a desired color. In the illustrated example, the adapter 14 and nut 30 have matching outer conical surfaces which typically would be visible, and treating those surfaces in particular allows a wide variety of aesthetic appearances. Along those same lines, it should be understood that the outer shape need not be conical such as shown, and instead could be provided in many different shapes according to the tastes and design of the room in which the connector 10 is to be used.

Screwed into the opposite end of the nipple threaded opening 38 is a threaded insulator 42. As best seen in FIG. 3, the insulator 42 has a central cylindrical opening 44 with a tapered restriction 46 at the inner end. The insulator 42 is made of a non-conductive material, such as nylon. The outer end of the insulator 42 includes a ridge 48 which abuts the connector nipple 36 when assembled.

Fit into the outer end of the insulator opening 44 is a connector contact or second base member 50, which is preferably made of a conductive material such as metal. The connector contact 50 has a stem portion 52 with ridges therearound so that the stem portion 52 may be press fit into the insulator 42 and securely retained therein.

As best seen in FIG. 5, the connector contact 50 also includes a head portion 54 which has a pocket 56 therein into which a cylindrical opening 58 in the stem portion 52 leads. The head portion 54 also includes a pair of transverse openings 60, 62 extending to the pocket 56, one opening 60 being threaded and receiving a suitable set screw 66 therein and the other opening 62 being for observation into the pocket 56 as described in greater detail hereafter.

The stem portion 52 of the connector contact 50 is shorter than the insulator 42, and the insulator ridge 48 spaces the connector contact 50 from the connector nipple 36 so that the nipple 36 and contact 50 are electrically insulated from one another.

It should be understood that the above details are merely exemplary of one embodiment of a connector 10 which embodies the present invention, and that the particular components, shape of components, and connection of such components could be very different from this embodiment and still embody the present invention.

Use of the connector 10 is thus easily accomplished as follows.

A suitable coaxial cable 70 (as described further below) is cut to a desired length. As shown in FIG. 6, the coaxial cable 70 preferably includes a central, inner cable or wire 72 surrounded by an insulating material 74, and an outer cable or wire 76 surrounds the insulating material 74. For example, in low voltage lighting systems with which the present invention may be advantageously used, an 18 gauge coaxial cable 70 having Teflon insulation 74 with a tin plated copper braided sheath forming the outer cable or wire 76 would be suitable. With such low voltage systems, insulation over the outer cable 76 is not required.

The coaxial cable 70 as illustrated in FIG. 6 illustrates the manner in which the coaxial cable 70 would have to be trimmed during installation according to the prior art described herein. However, for purposes of the invention, the outer cable 76 and insulating material 74 do not need to be trimmed to expose the inner cable 72. Rather, as previously stated, prior to assembly with the connector 10 of the present invention, the cable 70 is cut to length by a simple cut, with the inner cable 72, insulating material 74 and outer cable 76 all terminating at the end of the cable 70.

The cut cable 70 is then pushed into the adapter cylindrical opening 16, passing through the cylindrical opening 16 until exiting from the adapter threaded portion 18 inside the connector nipple 36. Pushing the cable 70 further into the connector 10 causes the cable end, and specifically the inner cable 72 and the insulating material 74 (generally adhered to the inner cable 72) to be guided to the center by the taper at the restriction 46. The restriction 46 is wide enough to allow the inner cable 72 and insulating material 74 to pass therethrough, but blocks the outer cable from entering. Continuing to push the cable 70 into the connector 10 will therefore cause the inner cable 72 and insulating material 74 to push forward through the insulator cylindrical opening 44 and into the contact stem portion cylindrical opening 58 until it abuts the end of the opening inside the pocket 56. The observation opening 62 allows the installer to see that the inner cable 72 has advanced far enough, and the installer may then tighten the set screw 66 in the connector contact 50 to pinch the end of the inner cable 72 against the opposite wall of the pocket 56 and thereby secure the inner cable 72 at that position. Further, use of a suitable hard, conductive set screw 66 will cause the set screw 66 to break through the insulating material 74 when tightened and create an electrically conductive connection between the inner cable 72 and the connector contact 50. The set screw 22 in the connector adapter 14 is also then tightened to also bind the entire cable 70 in the adapter cylindrical opening 16. Of course, the outer cable 76 will then be in contact with the connector adapter 14 to form an electrically conductive connection therebetween which is insulated from electrical contact with the inner cable 72 and connector contact 50. Thus, the set screw 22 in the adapter 14 need not be conductive, and can, for example, be made of nylon.

Figure 7:
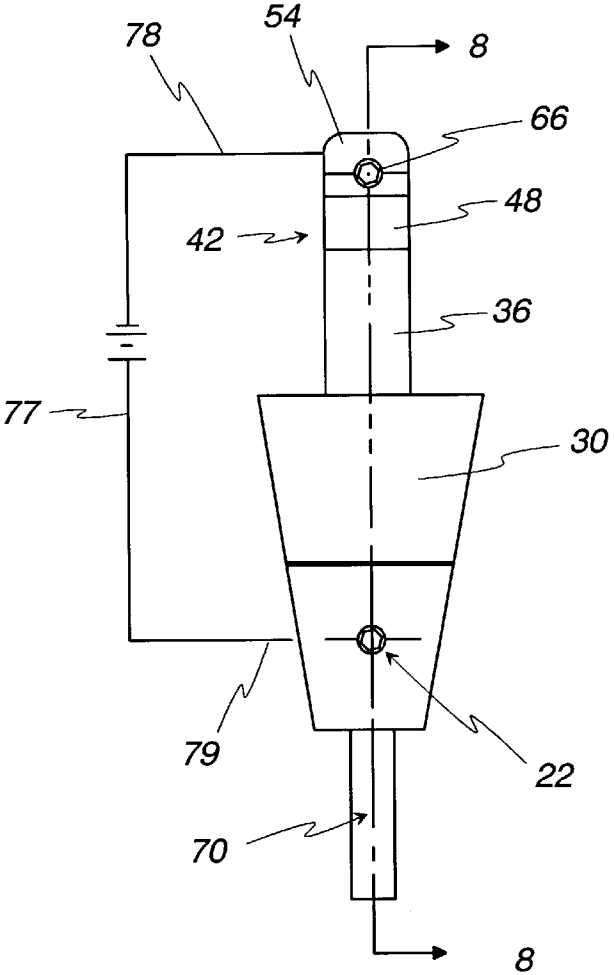
FIG. 7 is a side view of the FIG. 1 connector assembled with a coaxial cable.

Accordingly, the connector 10 can be connected to a suitable base having, for example, two terminals of a power circuit, so that the two cables 72, 76 of the coaxial cable 70 can be separately connected to the terminals to allow the power circuit to be connected to the other end of the coaxial cable 70. A power circuit 77 is schematically illustrated in FIG. 7, showing one side or terminal 78 of the circuit 77 electrically connected in any suitable manner to the head portion 54 and the other side or terminal 79 of the circuit 77 electrically connected in any suitable manner to the connector adapter 14.

Figure 10:
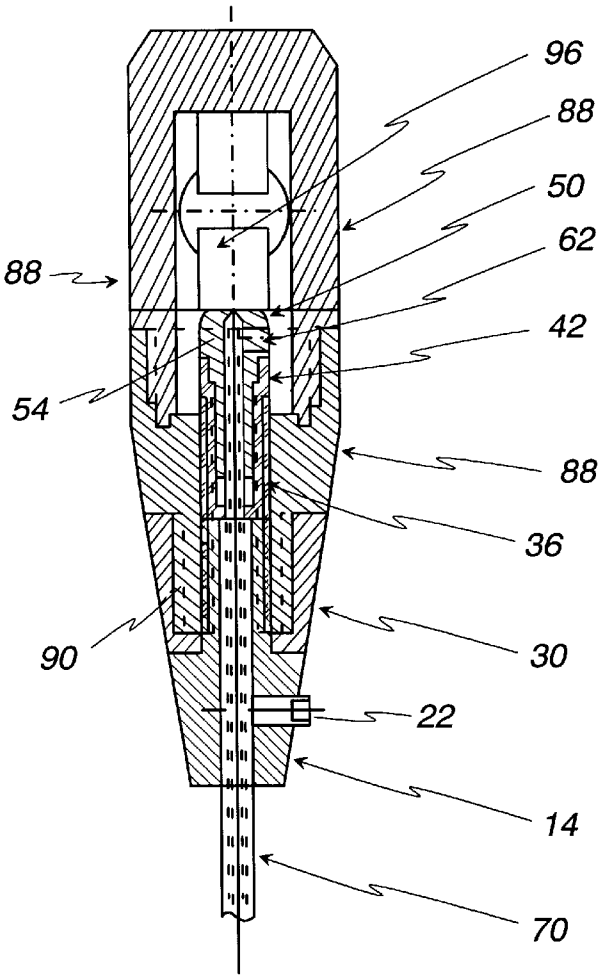
FIG. 10 is a cross-sectional view taken along line 10—10 of FIG. 9.
Figure 9:
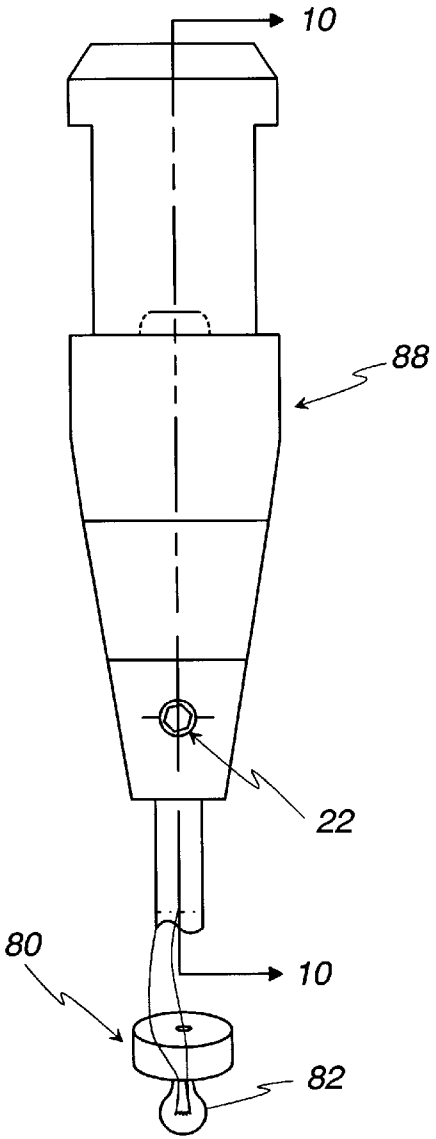
FIG. 9 is a side view of the connector such as shown in FIG. 7 as attached to a base having a power circuit, with a light fixture schematically shown thereon.

An example of such a connection is illustrated in FIGS. 9–10. As illustrated schematically, a light fixture 80 may be suitably secured to hang from the bottom of the coaxial cable 70, with the outer cable 76 connected to one side of the light 82 and the inner cable 72 connected to the other side of the light so that an electric current through either the inner or outer cable 72, 76 will flow through the light 82 and then through the other of the inner and outer cable 72, 76 when the circuit connected at the other end of the coaxial cable 70. In the illustrated example base 88, a cylindrical flange 90 depends downwardly and the connector nut 30 may be threaded thereon (recall that the nut 30 is mounted for free pivoting around the adapter threaded portion 18). The outer cable 76 is then suitably electrically connected to a portion of the base 88 which is itself electrically connected to one terminal of a power circuit. The connector contact 50 extends into an opening in the base 88 so that its head portion 54 is spaced from and electrically insulated from the base portion electrically connected to the outer cable 76. A suitable contact structure 96 is contacted by the connector contact 50 when mounted as described above, the contact structure 96 being electrically connected to the other terminal of the power circuit and insulated from the other base portion connected to the one power circuit terminal. It should be understood, however, that the base 88 and connection thereto described above are merely illustrative of one type of structure which may be used with a particular connector 10 embodying the present invention. A wide variety of different bases and circuits may be used together with a wide variety of connector structures which provide the above described advantageous structure in which the coaxial cable 70 may be easily and reliably cut and then installed in the connectors of the present invention.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained. Specifically, it should be understood that the detailed description is intended to describe many different features and advantages of the invention which might be obtained and is not intended to indicate that any use of the invention which does not provide each and every one of the advantages or use each and every one of the features described herein would be outside the scope of the overall invention envisioned by the applicant and described and variously claimed herein.

What is claimed is:

1. A connector for a coaxial cable having an conductive inner cable surrounded by a conductive outer cable with an insulator between said inner and outer cables, comprising:

a conductive first base member having a first opening therethrough for receiving said inner and outer cables therein, said first base member being connectable to one side of a circuit;

a first clamping member for securing said outer cable when in said first base member opening;

an insulating member secured to said first base member and having a second opening therethrough substantially in alignment with said first base member first opening, said second opening being restricted relative to said first base member first opening whereby said second opening receives said inner cable and said insulator and blocks said outer cable from entry into said second opening;

a conductive second base member secured to said insulating member and conductively insulated from said first base member, said second base member having a pocket substantially in alignment with said first and second openings and receiving said inner cable and said insulator therein, said second base member being connectable to the other side of the circuit;

a second clamping member for securing said inner cable when in said second base member pocket.

2. The connector of claim 1, wherein said second opening includes a tapered opening adjacent said first base member, said tapered opening for guiding said inner cable and insulation into said second opening while blocking said outer cable.

3. The connector of claim 1, wherein said first and second clamping members comprise set screws in threaded holes oriented substantially perpendicular to the orientation of a coaxial cable when connected thereto, said set screws for pinching the coaxial cable in the first base member opening and second base member pocket when received therein.

4. A connector for a coaxial cable having an conductive inner cable surrounded by a conductive outer cable with an insulator between said inner and outer cables, comprising:

a conductive first base member having a first opening therethrough for receiving said inner and outer cables therein, said first base member being connectable to one side of a circuit;

a first clamping member for securing said outer cable when in said first base member opening;

an insulating member secured to said first base member and having a second opening therethrough substantially in alignment with said first base member first opening;

a conductive second base member secured to said insulating member and conductively insulated from said first base member, said second base member having a pocket substantially in alignment with said first and second openings and receiving said inner cable and said insulator therein, said second base member being connectable to the other side of the circuit;

a transverse opening in said second base member providing a visual opening into said pocket; and a second clamping member for securing said inner cable when in said second base member pocket.

5. The connector of claim 1, wherein said insulating member second opening receives a portion of said second base member therein, said portion of said second base member having a central opening extending to said pocket for receiving said inner cable and insulator therethrough.

6. A connector for a coaxial cable having an conductive inner cable surrounded by a conductive outer cable with an insulator between said inner and outer cables, comprising:

a conductive first base member having a first opening therethrough for receiving said inner and outer cables therein, said first base member being connectable to one side of a circuit;

a first clamping member for securing said outer cable when in said first base member opening;

an insulating member secured to said first base member and having a second opening therethrough substantially in alignment with said first base member first opening;

a conductive second base member secured to said insulating member and conductively insulated from said first base member, said second base member having a pocket substantially in alignment with said first and second openings and receiving said inner cable and said insulator therein, said second base member being connectable to the other side of a second clamping member for securing said inner cable when in said second base member pocket, wherein said second clamping member breaks through said insulator to create a conductive connection between said inner cable and said second base member when said inner cable is secured in said second clamping member.

7. A hanging light, comprising:

a light fixture having two terminals;

a coaxial cable having an conductive inner cable surrounded by a conductive outer cable with an insulator between said inner and outer cables, said inner cable being conductively connected to one terminal of the light fixture and the outer cable being conductively connected to the other terminal of the light fixture; and a connector for connecting to two sides of a power circuit, said connector including a conductive first base member for connecting to one side of the power circuit and having a first opening therethrough receiving said inner and outer cables therein, a first clamping member securing said outer cable in said first base member opening, an insulating member secured to said first base member and having a second opening therethrough substantially in alignment with said first base member first opening, said second opening being restricted relative to said first base member first opening whereby said second opening receives said inner cable and said insulator and blocks said outer cable from said second opening, a conductive second base member secured to said insulating member and conductively insulated from said first base member, said second base member for connecting to the other side of the power circuit and having a pocket substantially in alignment with said first and second openings and receiving said inner cable and said insulator therein, and a second clamping member for securing said inner cable in said second base member pocket.

8. The hanging light of claim 7, wherein said second opening includes a tapered opening adjacent said first base member, said tapered opening guiding said inner cable and insulation into said second opening while blocking said outer cable.

9. The hanging light of claim 7, wherein said first and second clamping members comprise set screws in threaded holes oriented substantially perpendicular to the orientation of a coaxial cable when connected thereto, said set screws pinching the coaxial cable in the first base member opening and second base member pocket.

10. The hanging light of claim 7, further comprising a transverse opening in said second base member providing a visual opening into said pocket.

11. The hanging light of claim 7, wherein said insulating member second opening receives a portion of said second base member therein, said portion of said second base member having a central opening extending to said pocket for receiving said inner cable and insulator therethrough.

12. The hanging light of claim 7, wherein said second clamping member breaks through said insulator to create a conductive connection between said inner cable and said second base member through said second clamping member.

* * * * *